US008231295B2

(12) United States Patent
Armstrong et al.

(10) Patent No.: US 8,231,295 B2
(45) Date of Patent: Jul. 31, 2012

(54) TOGGLING COSMETIC LACQUER DISPENSER AND DELIVERY

(76) Inventors: Steve Armstrong, San Juan Capistrano, CA (US); Craig Carroll, Newport Beach, CA (US)

( * ) Notice: Subject to any disclaimer, the term of this patent is extended or adjusted under 35 U.S.C. 154(b) by 327 days.

(21) Appl. No.: 12/056,492

(22) Filed: Mar. 27, 2008

(65) Prior Publication Data

US 2009/0245918 A1 Oct. 1, 2009

(51) Int. Cl.
*B43K 24/02* (2006.01)

(52) U.S. Cl. ..... 401/101; 401/115

(58) Field of Classification Search ..... 401/115, 401/101, 138, 269, 270, 116, 129, 176, 274, 401/277, 280; 215/316, 320
See application file for complete search history.

(56) References Cited

U.S. PATENT DOCUMENTS

| | | | | |
|---|---|---|---|---|
| 2,611,915 | A * | 9/1952 | Prokop et al. | 401/116 |
| 2,932,046 | A * | 4/1960 | Skolnikoff | 401/115 |
| 2,944,274 | A * | 7/1960 | Hopkins | 401/102 |
| 3,035,299 | A * | 5/1962 | Gordon et al. | 401/107 |
| 4,029,422 | A | 6/1977 | Pillsbury | |
| 4,063,829 | A * | 12/1977 | La Mura | 401/101 |
| 4,594,014 | A * | 6/1986 | Korper | 401/115 |
| 5,735,623 | A * | 4/1998 | Gueret | 401/115 |
| 6,764,239 | B2 * | 7/2004 | Kim | 401/108 |
| 7,461,988 | B2 * | 12/2008 | Albisetti | 401/116 |
| 2004/0184865 | A1 | 9/2004 | Carroll | |
| 2006/0207622 | A1 * | 9/2006 | Gueret | 132/74.5 |

FOREIGN PATENT DOCUMENTS

WO PCT/US2008/074959 11/2008

* cited by examiner

*Primary Examiner* — David J. Walczak
*Assistant Examiner* — Jennifer C Chiang
(74) *Attorney, Agent, or Firm* — John K. Buche; Buche & Associates, P.C.

(57) ABSTRACT

A toggling dispenser is disclosed with a reservoir capable of containing substances and an integrally placed applicator which, at the user's election, enters and exits the dispenser by shifting or shaking the dispenser. While inside the dispenser, an amount of contained substance collects on the applicator so that when the applicator exits the enclosure, the collected substance may be delivered to a target via contact with the applicator.

25 Claims, 9 Drawing Sheets

TOGGLING COSMETIC LACQUER DISPENSER AND DELIVERY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application is in the field of apparatuses for dispensing cosmetic lacquers. Specifically, the present application is in the field of apparatuses for dispensing and applying cosmetic lacquer to finger and toe nails. More specifically, the present application is an all-in-one delivery apparatus that facilitates application of finger and toe nail polish, and the like (e.g., the applicator and lacquer reservoir are integrally associated as a single unit).

2. Background of the Invention

Typically, cosmetic lacquers are stored in small glass or plastic bottles. The caps to these typical embodiments have an applicator brush which attaches to and extends from the inner surface of the cap. When the user of these typical embodiments wishes to apply the lacquer, the user must use two hands—one to hold the bottle and one to apply the lacquer using the cap/brush applicator. A user may attempt to apply the lacquer single-handedly by placing the bottle of lacquer on a table or other surface, thereby eliminating the need for a second hand. However, such a practice leaves the bottle susceptible to tipping over when the user re-inserts the cap/brush applicator into the bottle to gather additional lacquer on the applicator or when that user seeks to place the cap back on the bottle. A further limitation of the typical embodiment is that, since the brush-applicator is limited in its reach by its attachment to the cap, the brush-applicator is incapable of reaching all of the inner surfaces of the reservoir bottle where usable lacquer may remain.

There have been numerous attempts to resolve the various problems described above, as well as others, yet so far, each proposed solution has proven inadequate. For instance, one such design features an applicator which is isolated from the lacquer reservoir during periods of non-use, rather than submerged therein like the typical embodiments. This results in the brush drying out and becoming unusably brittle and stiff. Others employ a disposable dispenser for "one-time" use, which results in excessive waste and additional costs for the user. The limitations of these designs are obvious.

SUMMARY OF THE INVENTION

Accordingly, it is an object of the present invention to provide a toggling cosmetic lacquer dispenser, which incorporates the lacquer or other desired fluid substance reservoir and fluid substance applicator into a single unit.

It is another object of the present invention to provide a toggling cosmetic lacquer dispenser which maximizes the use of fluid substance remaining in the fluid substance reservoir.

It is yet another object of the present invention to provide a toggling cosmetic lacquer dispenser which employs a shut-off function to minimize spillage of the fluid substance stored in the reservoir, even when the dispenser is inadvertently tipped over.

A further object of the present invention is to provide a toggling cosmetic lacquer dispenser which saturates the applicator in the fluid substance stored in the reservoir cavity during storage, thus preventing the drying out of the applicator and allowing applicator reusability.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which:

FIG. 15 also represents an inventory of components used for assembly of one possible embodiment of the dispenser 1.

Figure 1:
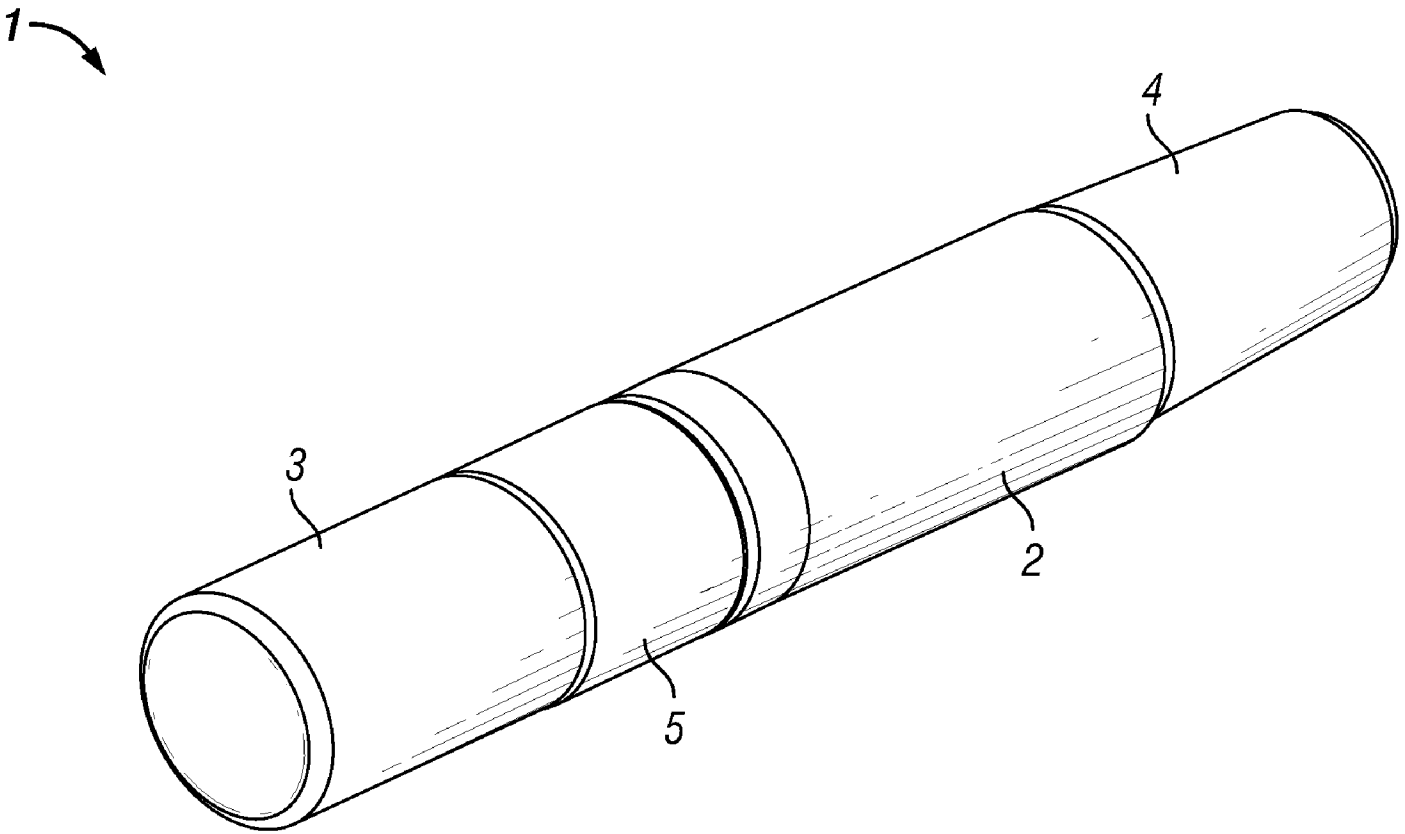
FIG. 1 is a perspective view of a dispenser 1 in a closed configuration.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

The dispenser 1 of the present application generally has a reservoir cavity 20 capable of holding fluid substances and an integrally placed applicator 7 operationally configured to enter and exit a reservoir cavity 20. While inside the reservoir cavity 20, the fluid substance stored therein suitably collects on the applicator 7 in a desirable amount. The applicator 7 then may be extended outside the reservoir cavity 20, and the fluid substance collected upon the applicator may then be delivered to a target via contact with the applicator 7. This process may then be repeated until the fluid substance stored within the reservoir cavity 20 has been completely depleted. The more specific elements of the dispenser 1 are depicted in the drawings.

FIG. 1 depicts the dispenser 1 in a closed configuration. The reservoir 2 and head 5 form an enclosure capable of holding fluid substances. At one end of the reservoir 2 is the tail cap 4, and at the opposite end of the reservoir 2 is the head 5. The defining feature of a closed configuration is a cap 3 positioned over the distal portion of the head 5.

The reservoir 2 is often made of a transparent material that is also capable of forming a leak-proof seal, but such is not a requirement. However, the materials suitable for forming the reservoir 2 will vary depending on the physical properties of the substance stored therein, and the exact nature of the dispenser 1 use. For instance, transparency of the reservoir 2 is ideal in the cosmetics field because a user may readily ascertain the qualities of the substance contained therein, such as color and remaining volume, and a sealed container prevents unwanted spillage. Keeping that in mind, the reservoir 2 may be formed using a variety of preferable materials, including but not limited to metals, glasses, alloys, composites, woods, and a variety of hard plastics including but not limited to high-density polyethylene, polypropylenes, PVC, and other materials that will be appreciated by those skilled in the art.

Figure 2:
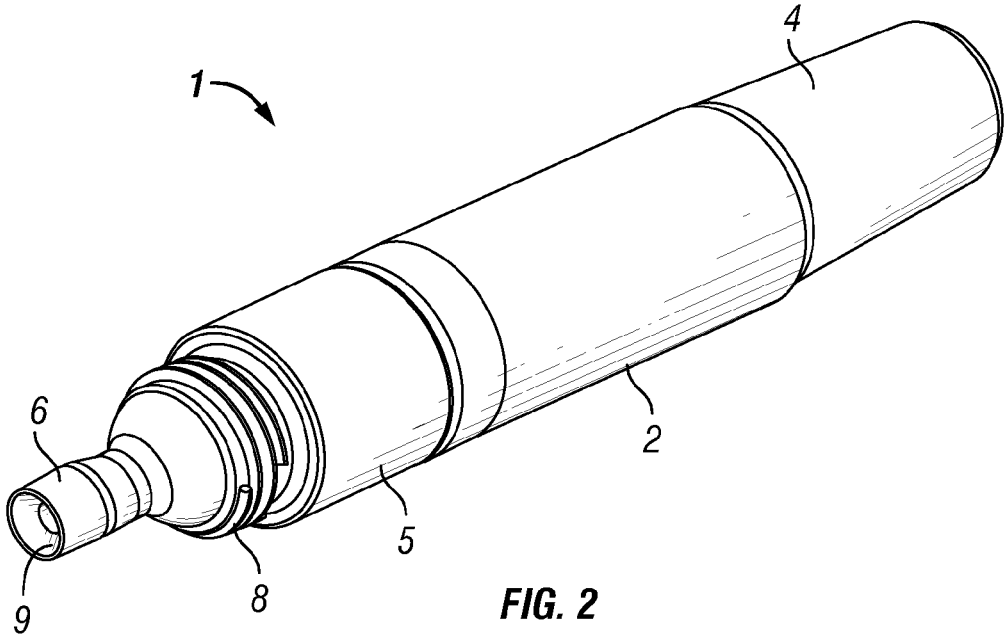
FIG. 2 is a perspective view of a dispenser 1 in an open configuration, with the cap 3 removed to expose the nose 6, and with an applicator 7 retracted into the dispenser 1.

FIG. 2 depicts the dispenser 1 in an open configuration. The open configuration of FIG. 2 is similar to the closed configuration of FIG. 1, except that cap 3 has been removed from the distal portion of the head 5 to expose the nose 6. The nose 6 features an avenue 9 whereby the applicator 7 enters and exits the head 5 when the user tilts the dispenser 1 either vertically up or down, respectively. As illustrated, FIG. 2 depicts the applicator 7 in a retracted position.

Figure 3:
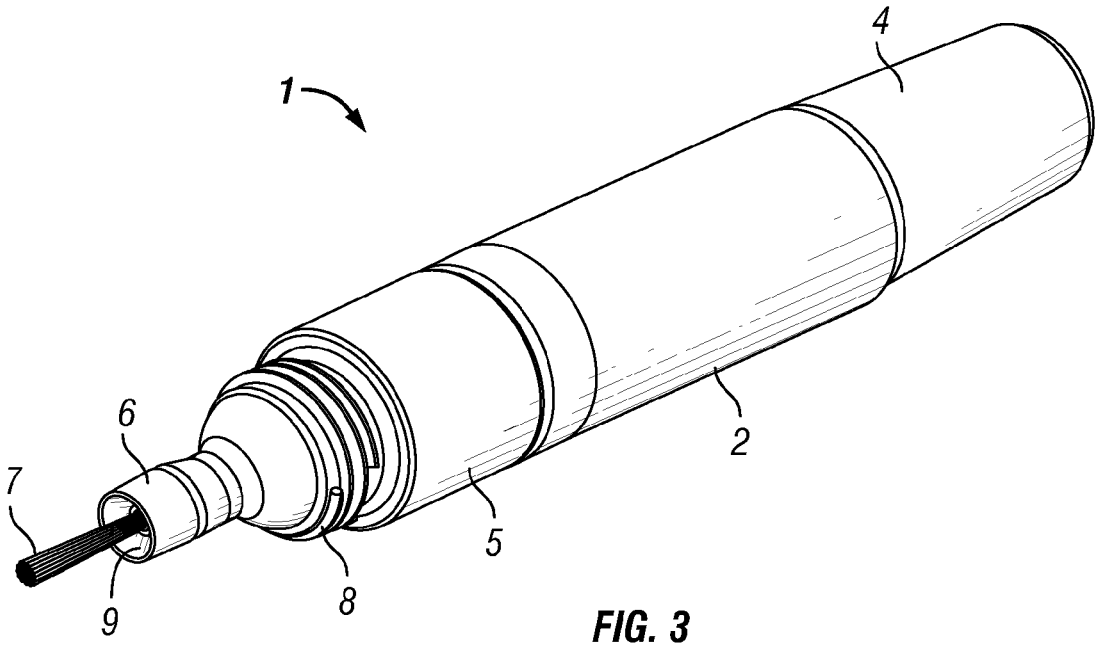
FIG. 3 is a perspective view of a dispenser 1 in a delivery configuration, with the cap 3 removed to expose the nose 6, the nose 6 having an applicator 7 extending distally therefrom.

FIG. 3 depicts the dispenser 1 in a delivery configuration, in which the applicator 7 is extended and ready for use. The delivery configuration of FIG. 3 is similar to the open configuration of FIG. 2, except that the applicator 7 in FIG. 3 is shown extended out of the nose 6 through the avenue 9. As explained in more detail below, in this delivery configuration the fluid substance stored within the reservoir 2, and which previously collected on the applicator 7 may be delivered to a target via contact with the applicator 7 once it is extended.

Figure 4:
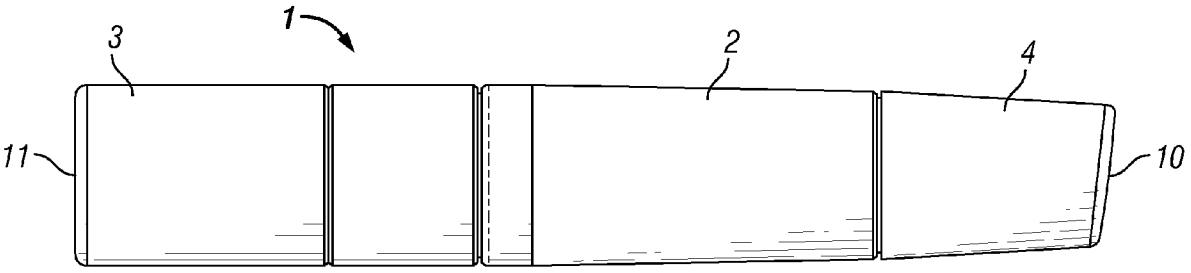
FIG. 4 is a side perspective of the dispenser 1 of FIG. 1 in a closed position.
Figure 5:
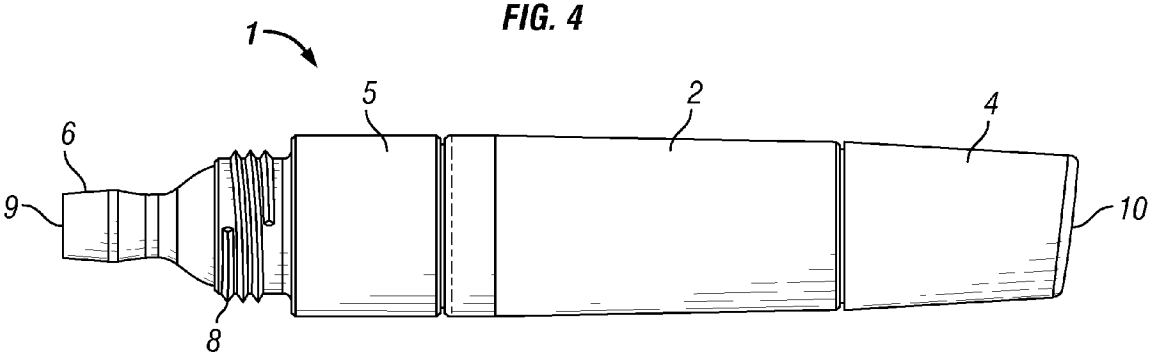
FIG. 5 is a side perspective of the dispenser 1 of FIG. 2 with the cap 3 removed, and with an applicator 7 retracted into the dispenser 1.
Figure 6:
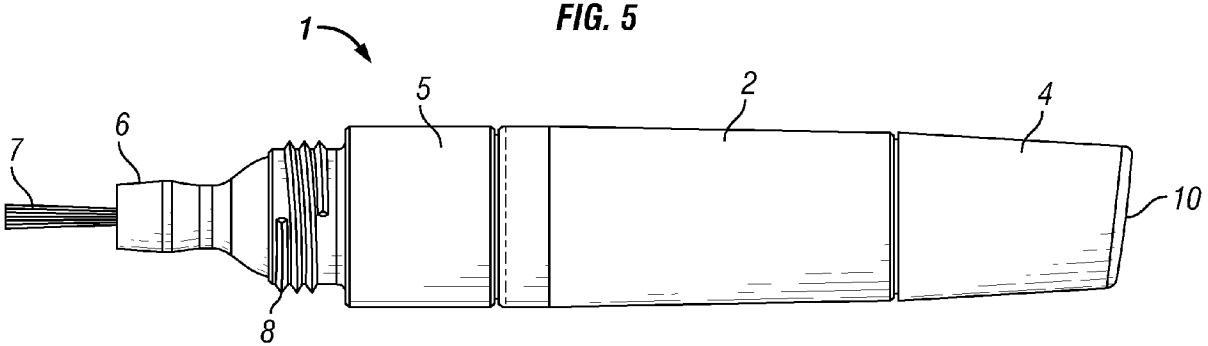
FIG. 6 is a side perspective of the dispenser 1 of FIG. 3, with an applicator 7 distended.

FIGS. 4, 5, and 6 depict side perspectives of the dispenser 1 and show the same relative components in the same relative positions as FIGS. 1 through 3, respectively. Additionally, these figures depict features of the tail cap 4 not readily ascertainable from FIGS. 1 through 3. In the present embodiment, the tail cap 4 is not usually removable at the election of the user. However, alternative embodiments may make use of a tail cap 4 removable at the user's election.

The tail cap 4 serves a variety of functions. First, the tail cap 4 fits around the anterior of the body 2, wherein the outer surface of the body 2 and the outer surface the tail cap 4 smoothly align to give a unified appearance to the tail cap 4 and body 2 assembly. Secondly, the beveled design of the tail cap 4 in the present embodiment of the dispenser 1 prevents the tail cap 4 from being used as a base during storage of the dispenser 1 during periods of non-use. Since the internal components are suitably situated more toward the head 5, storing the dispenser 1 upright with the tail cap 4 used as a base for an extended period of time will result in said internal components withdrawing from the fluid substance stored in the reservoir 2. When said internal components are not submerged in said fluid substance, the fluid substance remaining on said internal components may dry out and harden. Such hardening prevents said internal components from functioning as designed. In the present embodiment, the tail cap 4 has a beveled distal end 10, thus discouraging the storage problem discussed above. Conversely, upright positioning with the cap 3 as the base is encouraged and even facilitated by the design of the flat cap top 11 of the cap 3, especially considering the fact that vertical positioning in this manner is a likely form of merchandising.

It is important to note that although the drying out and solidifying of the fluid stored in the reservoir 2 is a concern, as discussed above, such an occurrence will not result in total failure of the dispenser 1. Dried out internal components may be cured to their functional states by resaturating said internal components with the fluid substance stored in the reservoir 2. This aspect is important, since the dispenser may be stored in a shipping box or display case with the tail cap facing down, for an extended time period. The product would then become usable again once the dispenser was properly positioned for an adequate period of time to allow resaturation of the internal components.

The third function of the tail cap 4 is aesthetic. As discussed further below, the fluid substance stored in the reservoir 2 does not fully occupy the available volume of the reservoir 2 because various internal components occupy the dispenser 1 which require space to function properly. Accordingly, some initial under-fill of the reservoir 2 must be taken into account to prevent overflow of said fluid substance during dispenser 1 assembly. When the dispenser 1 is displayed for sale the potential consumer may be off-put by a reservoir 2 which appears to not be filled to capacity. The appearance of under filling would be particularly exaggerated while in the upright position using the cap 3 as the base. To solve this potential problem, an opaque tail cap 4 may be used to conceal the requisite under-fill level and extend over the reservoir 2 to a suitable extent, thereby further concealing the level of fluid substance stored therein.

Though the present embodiment depicts the tail cap 4 as a separate component of the dispenser 1, applicant also contemplates a tail cap 4 that defines the butt of the reservoir 2. The same features of the tail cap 4 in that alternate embodiment can be accomplished through proper shaping of the reservoir's 2 butt and through paint (or opaque materials). Thus, a separate tail cap 4 is essentially an optional component of the dispenser 1. Accordingly, one alternate embodiment of dispenser 1 would truncate after the reservoir 2. Other alternate embodiments will be readily apparent to those skilled in the art.

The typical use of the dispenser 1 of the present application can be illustrated by FIGS. 1, 2, 3, 4, 5, and 6 in combination. First, the cap 3 is removed from the head 5 of the dispenser 1 of FIGS. 1 and 4, thereby exposing the nose 6 as depicted in FIGS. 2 and 5. In the present embodiment, coupling of the cap 3 and head 5 parts is achieved via a "screw" and "nut" mechanism, whereby the head 5 effectively screws into the cap 3 via a head screw 8. Thus, one rotates the cap 3 to unscrew it from the head 5 along the head screw 8. However, a "screw" and "nut" mechanism is not the only means for securing the cap 3 over head 5 and such other appropriate means (for example, snap, squeeze, clip, stick, press, interlock, and the like) will be readily available to one skilled in the art.

Figure 8:
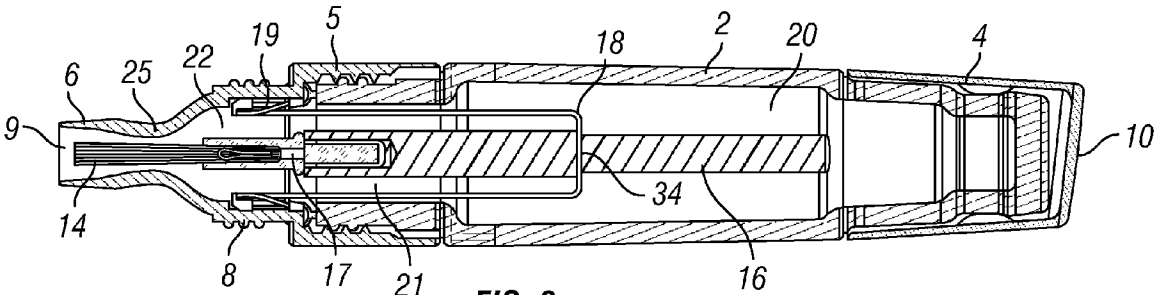
FIG. 8 is a longitudinal cross-section of the dispenser 1 of FIG. 5 with cap 3 removed and with applicator 7 distended.
Figure 9:
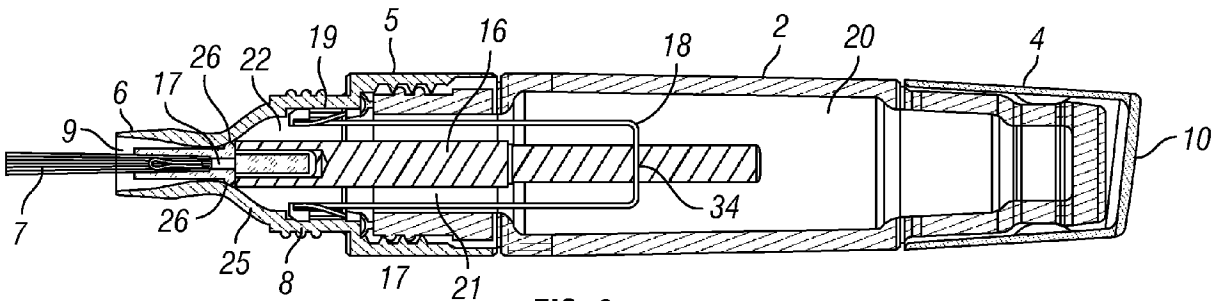
FIG. 9 is a longitudinal cross-section of the dispenser 1 of FIG. 6 with cap 3 removed and with applicator 7 extended.

Next, with the cap 3 removed, as shown in FIGS. 2, 5 and 8, the applicator 7 may be exposed, as shown in FIGS. 3, 6 and 9, by suspending the dispenser 1 with the tail cap 4 and reservoir 2 raised vertically superior relative to the head 5 and nose 6. It should be kept in mind that complete extension of applicator 7 may also be achieved in any other suspended position wherein the tail cap 4 and reservoir 2 are raised relative to the nose 6 and head 5. Such a position will always result when a user holds the dispenser 1 at the head 5 or reservoir 2. In some limited respects, the method and orientation in which one typically uses the present dispenser 1 may resemble the way in which one typically uses an ink pen, with the pen's ink tip held below the body of the pen.

When a user has completed application of the fluid substance stored in the reservoir 2 and wishes to retract the applicator 7, the user simply rotates the dispenser 1 by lowering the tail cap 4 relative to the nose 6 and head 5. Stated more simply, a dispenser 1 is toggled by rocking it back and forth causing the applicator 7 to enter and exit the nose 6. The toggling parameters of a dispenser 1, loaded with nail polish, have been compared with the toggling parameters of an empty dispenser 1, wherein the weighted shaft 16 weighs 7.8 grams. The results indicate that if a loaded dispenser 1 is tilted around a central pivot point along the dispenser's 1 length, by 30° relative to a horizontal position, the applicator 7 extends from, or retracts within, the nose 6 depending on whether the head 5 or tail cap 4 is below the horizontal; if the head 5 is lower, the applicator 7 extends, if the tail cap 4 is below, the applicator 7 retracts. In contrast to a loaded dispenser 1, an empty dispenser 1 toggles with a 15° tilt relative to the horizontal. Of course, the toggling angles change with the viscosity of the loaded substance, and weight of the weighted shaft 16. For example, a dispenser 1 filled with water, toggles at similar angles to those mentioned above when the weighted shaft 16 weighs 0.4 grams.

The utility of the dispenser 1 lies in the above-mentioned toggling action, alternating between open (FIGS. 2 and 5) and delivery (FIGS. 3 and 6) configurations. Referring to FIGS. 2 through 6, a non-exclusive method of toggling suitably consists of a user holding a dispenser 1 in an open configuration by griping it approximately equidistant between the head 5 and tail cap 4 on the reservoir 2 and thereafter completing the following steps in order: (1) raising the head above the user's grip while simultaneously lowering the tail cap 4 below the user's grip (thereby causing retraction of applicator 7 into the reservoir 2); (2) returning the dispenser 1 to the initial position; and, finally (3) raising the tail cap 4 above the user's grip while simultaneously lowering the head 5 below the user's grip (thereby causing extension of applicator 7 from the avenue 9 at the nose 6). Subject thereto, toggling occurs whenever an applicator 7 transitions from an extended position to a retracted position and back (and/or vice versa). Fluid substance stored in the reservoir 2 will collect upon the applicator 7 during toggling between open and delivery configurations. After sufficient toggling, when a desired amount of fluid substance is accumulated on the applicator 7, the user utilizes the extended applicator 7 to apply the fluid substance to the desired target. It should be noted that when attached to the dispenser 1 the cap 3 prevents toggling, since the applicator 7 is blocked from exiting the dispenser 1 through the avenue 9 at the nose 6.

Figure 7:
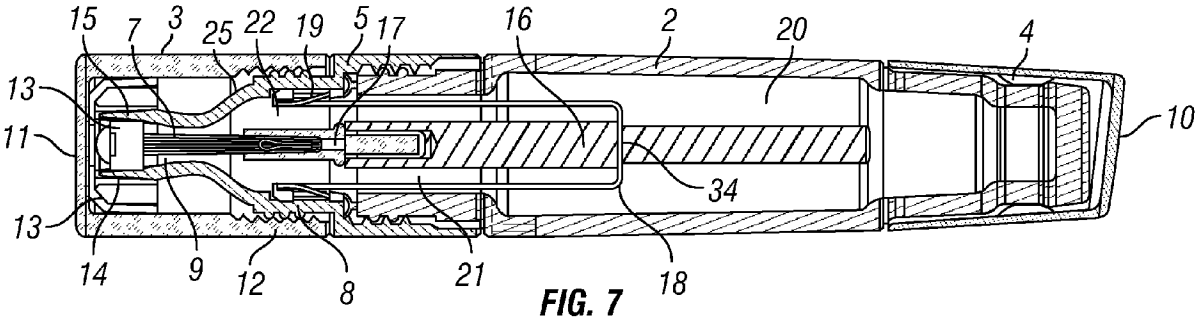
FIG. 7 is a longitudinal cross-section of the dispenser 1 of FIGS. 1 and 4 in a closed position.

FIG. 7 is a longitudinal cross-section of the dispenser 1 of FIG. 4 which illustrates the above-mentioned internal components of the dispenser 1. The internal components of the dispenser 1 depicted in FIG. 7 are generally as follows: the applicator 7; the applicator assembly 17; the weighted shaft 16; the shaft guide 18; and, the shaft guide base 19. Most particularly, FIG. 7 illustrates the internal components of the cap 3. As mentioned above, the cap 3 is removably fastened to the nose 6 by complementary coupling parts featured on the inside of the cap 3 and on the outside of the nose 6. In the present embodiment, the head screw 8 rotatably inserts into the cap nut 12 to achieve cap 3 attachment. Reversing this action results in cap 3 removal.

It should be noted that as depicted in FIG. 7, the cap 3 serves several purposes. First, the cap 3, when secured over the nose 6, prevents leakage of the fluid substances stored in the reservoir 2. As depicted clearly in FIG. 7, the cap 3 features a hood 13 with a receiver 14 that femininely accepts the nose 3, thereby forming a seal around the avenue 9. The aforementioned seal is formed via constriction of the receiver 14 around the nose 6. The nose 6 is able to insert into the receiver 14 since the nose 6 tip has a relatively smaller diameter than the receiver 14. However, the nose 6 tapers to a relatively larger diameter than the receiver 14, thereby causing the receiver 14 to expand elastically, and then constrict around the nose 6. It is this constrictive force which forms said seal and prevents the fluid substance stored in the reservoir 2 from leaking out of the avenue 9 when the cap is attached.

Second, and as mentioned above, the cap 3 prevents toggling when attached. In the present embodiment, as displayed in FIGS. 7 and 10, the cap 3 prevents toggling of the dispenser 1 because the stopper 15, which fits inside the receiver 14 when the dispenser 1 is in a closed configuration blocks the avenue 9 to stop the applicator 7 from exiting the nose 6. Additionally, the present embodiment of the stopper 15 aids in preventing leakages of the fluid substance stored in the reservoir 2 by essentially plugging the avenue 9.

FIG. 8 is a longitudinal cross-section of the dispenser 1 depicted in FIGS. 2 and 5 with the cap 3 removed and the internal components of the dispenser 1 in the same relative positions as depicted in FIG. 7. Note that the applicator 7 remains retracted into the nose 6 in this FIG. 8. FIG. 9 is a longitudinal cross-section of the dispenser as depicted in FIGS. 3 and 6 with the cap 3 removed and the applicator 7 extended through the nose 6. FIG. 9 also displays the weighted shaft 16 shifted into a position toward the head 5. Together, FIGS. 8 and 9 help provide a more detailed illustration of the functions and positions of the internal components during toggling, as described immediately below.

Beginning with FIG. 8, a dispenser 1 in an open configuration is usually held upright, with the nose 6 in the air. As the user tilts the nose 6 down relative to the tail cap 4, the fluid substance stored in the dispenser 1 begins to flow from the reservoir cavity 20 toward the head cavity 22. Meanwhile, the weighted shaft 16 travels along the shaft guide 18 and begins to push the applicator assembly 17 and the applicator 7 through the avenue 9. Essentially, the applicator 7 passes through the avenue 9 as it collects the fluid substance stored in the dispenser 1. Fluid substance collection on the applicator 7 is further aided by the weighted shaft 16, since the weighted shaft 16 displaces fluid while it pushes the applicator 7 from the nose 6, the weighted shaft 16 pumps fluid into the avenue 9 which the applicator 7 passes through during toggling.

Once the user has rocked the dispenser forward sufficient to extend the applicator 7 from the nose 6, the weight of the weighted shaft 16 presses the applicator assembly 17 against the nose cone 25, thereby creating a shut-off 26. This shut-off 26 prevents the fluid substance from further passing into the avenue 9, and also holds said fluid substance in the head cavity 22. The fluid substance in the avenue 9 is then collected by the applicator 7 upon the applicator's 7 return to the reservoir cavity 20 after the dispenser 1 is rocked back and the fluid substance and the internal components are shifted back into the reservoir cavity 20. Thus, a single toggle (in-and-out)

of the dispenser 1 is sufficient to collect a measure of fluid substance on the applicator 7 for delivery to a target. Moreover, additional accumulation of fluid substance on the applicator 7 may be accomplished by repeated toggling of the dispenser 1 if a heavier dose of substance is desired by the user.

The design of the applicator 7 should be considered in light of the tendency of the fluid substance stored in the dispenser 1 to dry out. The applicator 7 should be relatively flexible and ductile so that, when it is used for application purposes, it does not displace the shut-off 26, thus resulting in unwanted leakage of fluid substance. Accordingly, the applicator 7 of the present embodiment is depicted as a brush (or grouping of hair strands). Hypothetically, a danger exists when the dispenser 1 has an inflexible applicator 7 (whether due to poor design or dry-out), and a user attempts to apply the fluid substance collected on the applicator 7 by pressing the applicator 7 on a target. The stiffness of the applicator 7 would transfer the force of the delivery to the weighted shaft 16 thereby displacing the shutoff 26. Such an action may allow the fluid substance to leak through the avenue 9 in an unregulated fashion.

Depending on its intended use, alternative embodiments of the dispenser 1 may require components of differing sizes or shapes. For instance, the physical traits of the nose 6, weighted shaft 16 and the applicator assembly 17 help determine the amount of fluid substance that is dispensed with each toggle. Also, the physical properties of the fluid substance stored in the dispenser may determine the dimensions and traits of components in alternative embodiments. For example, a greater surface tension between the internal surface of the avenue 9 and the fluid substance stored in the dispenser 1 helps eliminate fluid drip from the nose 6 when the shut-off 26 is closed. Additionally, a higher surface tension between the nose cone 25 and the fluid substance assists in metering the amount of fluid substance that enters the avenue 9 while the shut-off 26 is open. In addition to surface tension considerations, the geometry of the nose 6 (including the avenue 9 diameter and the nose cone 25 angle) also contributes to the efficient metering of the fluid substance into the avenue 9 and the amount of fluid substance collected on the applicator 7 with each toggle. Accordingly, decisions as to the roughness of the surfaces, the type of materials employed, and fluid stored in the dispenser will be readily apparent to one skilled in the art.

Other design choices may be made in alternate embodiments as well. For instance, design aspects of the weighted shaft 16 and applicator assembly 17 play important roles in the metering of fluid substance through the avenue 9. When the weighted shaft 16 is moved back into the reservoir cavity 20, the fluid substance in the reservoir cavity 20 gets displaced. Since the diameter of the weighted shaft 16 is larger than the diameter of the applicator assembly 17, a void around the applicator assembly 17 is created by such a movement of the weighted shaft 16. The greater the difference in relative size between the weighted shaft 16 and the applicator assembly 17, the greater the void created around the applicator assembly 17. The displaced fluid then fills in the void created around the applicator assembly 17. Therefore, the size of the weighted shaft 16 and applicator assembly 17 are factors in determining the size of the void created, and thereby the amount of fluid pumped into avenue 9.

To function correctly, the dispenser 1 depends on the shut-off 26 to close properly once a sufficient amount of substance has been pumped into the avenue 9. In most instances, the user will want to have almost immediate recovery when the weighted shaft 16 is rocked backward and then forward during toggling. In addition to the weighted shaft 16 dimension considerations mentioned above, the size and weight of the weighted shaft 16 affects the speed at which the weighted shaft 16 moves through the fluid substance itself. Thus, if the weight is too low as compared to the viscosity of the fluid substance, the weighted shaft 16, and thus the applicator 7 too, will move back and forth through the fluid substance very slowly. For example, nail polish has a low viscosity and the weighted shaft 16 should be relatively heavy. Accordingly, a person skilled in the art would adjust the weight of the weighted shaft 16 according to the viscosity of the fluid substance stored in the dispenser 1.

FIGS. 8 and 9 also illustrate the importance of the shaft guide 18, which guides the weighted shaft 16 during toggling and limits the extent to which the applicator 7 may enter the dispenser 1 during toggling. The entry of the weighted shaft 16 into the dispenser 1 is so limited because the weighted shaft 16 is composed of two cylindrical segments of differing diameters. The rear of the shaft guide 18 suitably features an aperture 34 which is operationally configured to receive the cylindrical segment of the weighted shaft 16 with the smaller diameter, but not the segment with the larger diameter. Accordingly, when a user toggles the dispense to retract the applicator 7, said applicator 7 enters the nose 6. At the same time, the applicator assembly 17, and the weighted shaft 16 move relative to the shaft guide 18 through the aperture 34, until the junction of the smaller and larger diametered segments of the weighted shaft 16 meet the aperture 34. At that point, the segment of the weighted shaft 16 with the smaller diameter will have been received through the aperture 34, while the larger diametered segment of the weighted shaft 16 will not be allowed to pass through the aperture 34. The present embodiment of the dispenser 1 is suitably configured such that the weighted shaft 16 is sized so that the applicator 7 passes no further into the dispenser than the avenue 9 (as depicted by FIG. 8). If the weighted shaft 16 is improperly proportioned, unsmooth toggling may result, since the applicator 7 would need to reenter the avenue 9 with each and every toggle. However, alternate embodiments may be contemplated where the applicator 7 retracts completely into the reservoir cavity 20 or, conversely, completely exits the avenue 9 during toggling.

Figure 10:
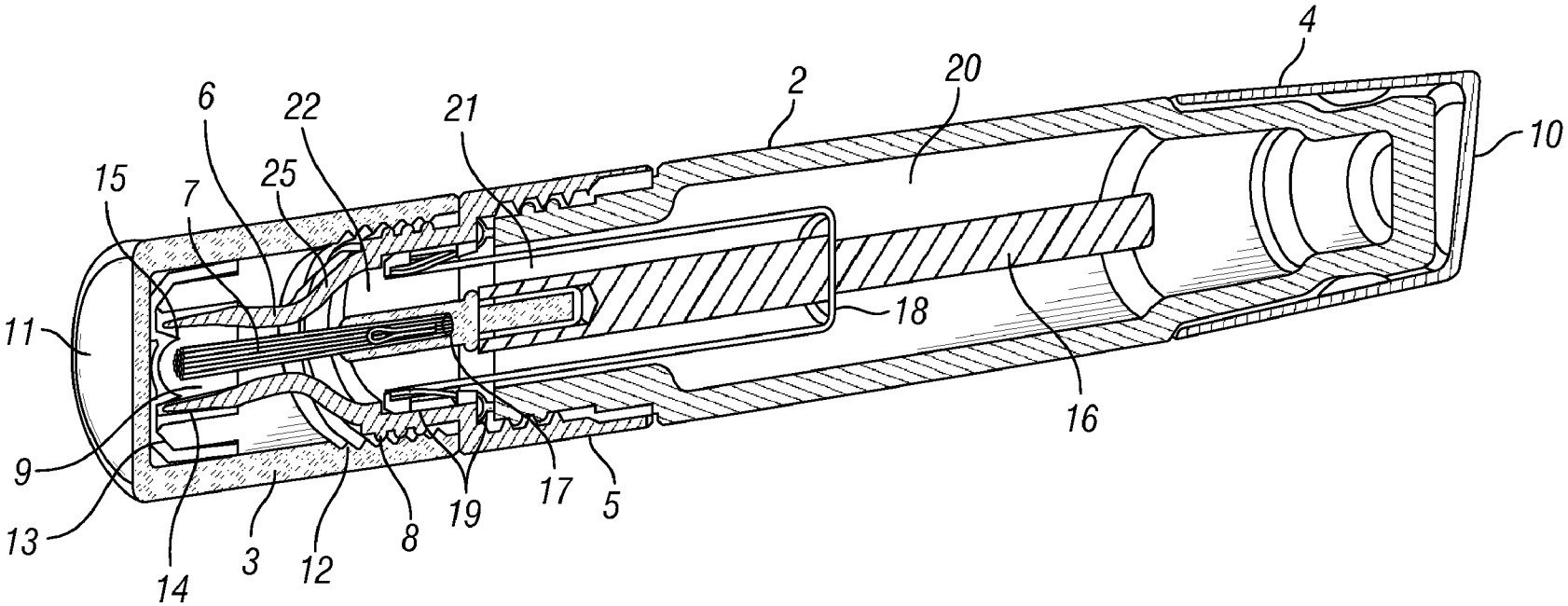
FIG. 10 is a three-dimensional longitudinal cross-section of the dispenser 1 of FIGS. 1 and 4.

FIG. 10 is a three-dimensional longitudinal cross section of the dispenser 1 of FIGS. 1, 4, and 7. In this configuration, the cap 3 is secured over the head 5, with the nose 6 inserted into the receiver 14, and with the stopper 15 blocking the applicator 7 from exiting the avenue 9. Note that here the shut-off 26, as described above, remains un-established. Though a closed shut-off 26 prevents fluid substance leakage during applicator 7 use, an open shut-off 26 is equally important during storage and when the cap 3 is affixed. When in such a configuration, stored fluid substance may freely enter and exit the avenue 9, thereby saturating the applicator 7 during fluid substance collection. Were the shut-off 26 able to close, the applicator 7 would be effectively isolated from the contained substance. Due to the high evaporation rates of cosmetic lacquers typically used, the fluid substance remaining on the applicator 7 could dry out, resulting in a stiff applicator 7 and the problems detailed above. Accordingly, the applicator 7 is usually rigid enough to withstand the weight of the weighted shaft 16, thereby preventing the shut-off 26 from being established. The applicator 7 of the present embodiment is a brush that is typically found in all current cosmetic lacquer dispensers. However, material with the necessary rigidity required to support an open shut-off 26 while the cap 3 is fastened to the dispenser 1, yet enough flexibility to permit a closed shut-off 26 during use, will be readily apparent to one skilled in the art.

Figure 11:
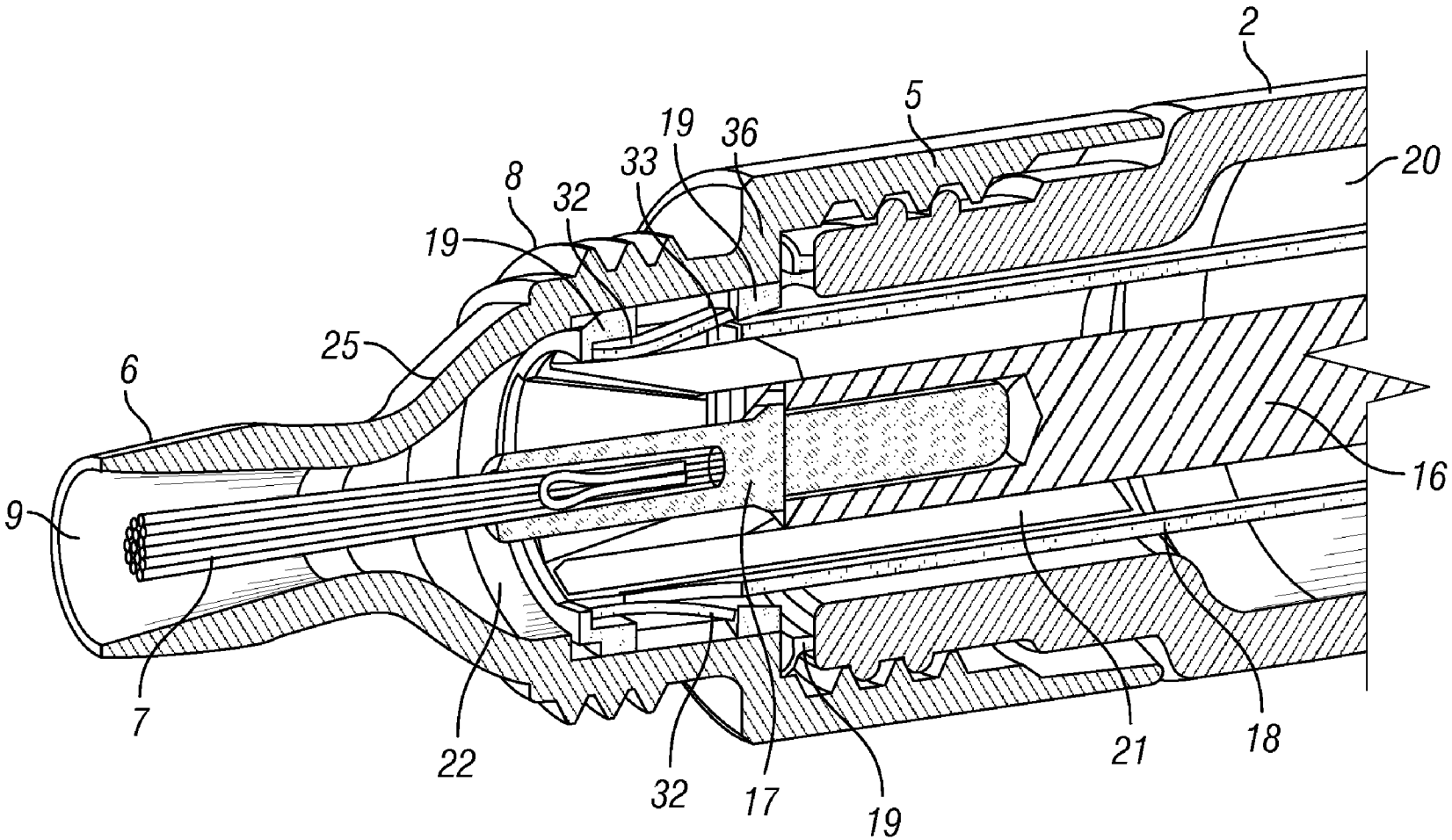
FIG. 11 is a three-dimensional rendering of a head 5 portion of a dispenser 1.
Figure 12:
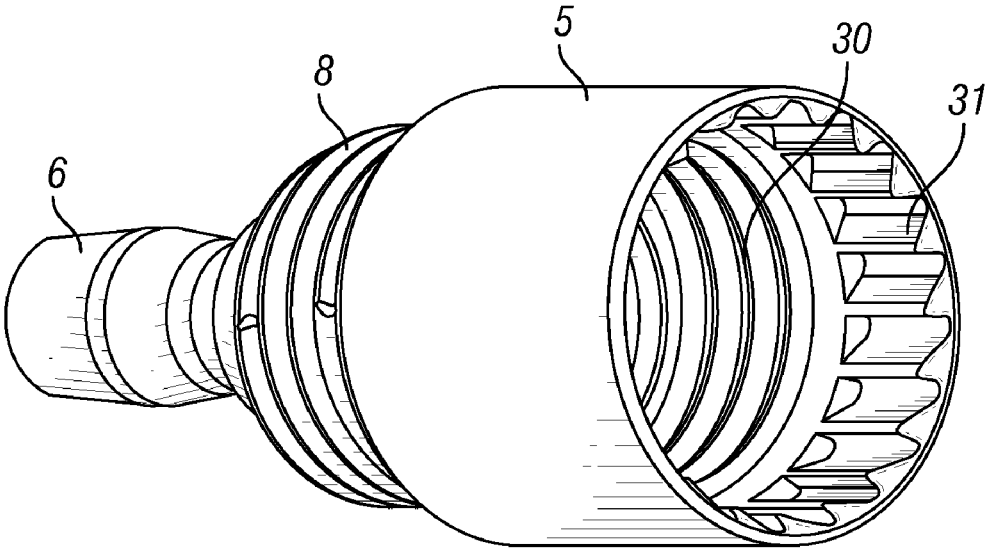
FIG. 12 is a three-dimensional aft-perspective of the head 5 disassociated from the dispenser 1, and displaying the nut threads 30 and teeth 31, therein.
Figure 13:
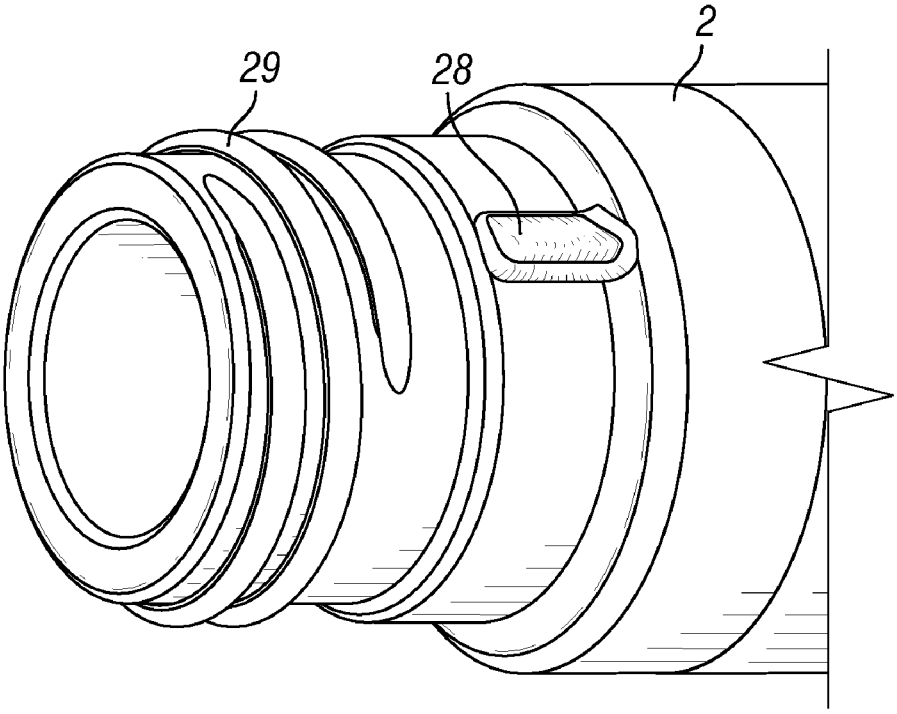
FIG. 13 is a three-dimensional rendering of an appendage of the reservoir 2, displaying the locking lugs 28 and screw threads 29.

FIG. 11 is a "zoomed in" cross-sectional view of a fully connect head 5 and reservoir 2. FIGS. 12 and 13 are three-dimensional perspectives of the receiving end of the head 5 and the male end of the reservoir 2 respectively. FIGS. 11 through 13 illustrate the elements utilized in making a connection between the head 5 and the reservoir 2 which forms the channel 21. First, as shown in FIG. 11, the applicator assembly 17, coupled with the weighted shaft 16, are inserted through the head 5 with the applicator 7 extended into the nose 6. Next, the shaft guide 18 is connected to the guide base 19 via extension of arms 32 into nooks 33. Then the guide base 19 and shaft guide 18 assembly are masculinely inserted into the receiving end of the head 5. Consequently, the smaller diameter segment of the weighted shaft 16 continues through the aperture 34 in the rear of the shaft guide 18. Then the weighted shaft 16 and shaft guide 18 are masculinely inserted into the reservoir 2 at the same end as the open end of the reservoir 2. The screw threads 29 of the reservoir 2 are then masculinely inserted into the head 5 and rotated in conjunction with the nut threads 30 to produce coupling. The locking lugs 28 on the reservoir 2 finally interact with the teeth 31 to prevent rotation in the opposite direction, effectively preventing uncoupling of the head 5 and reservoir 2. Though the locking lugs 28 and the teeth 31 are depicted in the FIGS. 12 and 13, various other methods and components known to those skilled in the art may alternatively be employed to accomplish relatively permanent coupling of the head 5 and reservoir 2, such as a snap on head 5 with a key built into the reservoir 2.

As illustrated in FIGS. 12 & 13, the locking lugs 28 and teeth 31 function to prevent unwanted head 2 removal when the cap 3 is being unscrewed and removed. Without said locking lugs 28, or similarly functioning mechanism, rotating the cap 3 relative to the dispenser 1 to remove the cap 3 may result in disassociation of the head 5 from the reservoir 2 and, consequently, spillage of the fluid substance contained therein. Other mechanisms may be utilized for the same function and would be readily apparent to a person skilled in the art.

Figure 14:
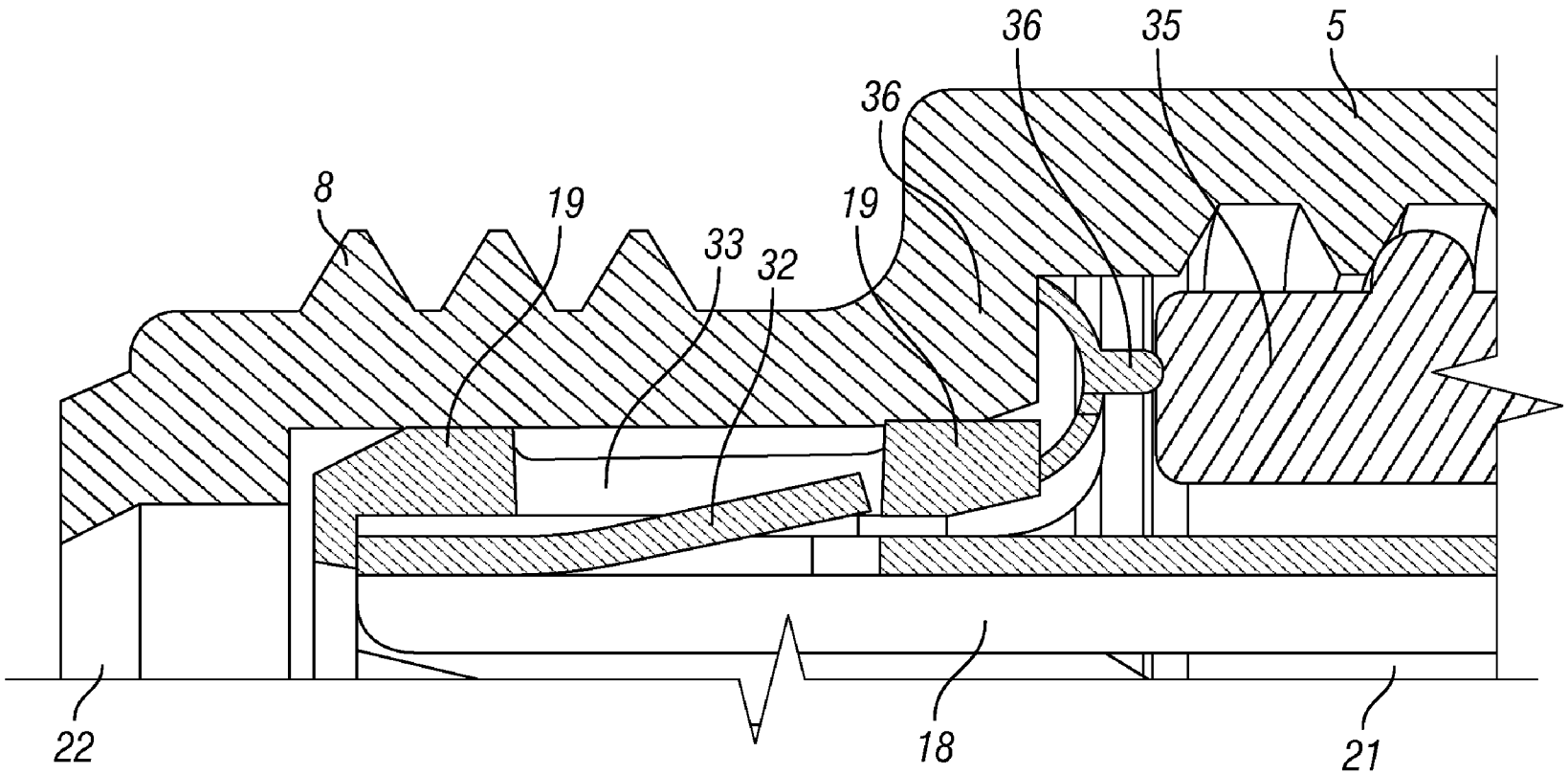
FIG. 14 is a "zoomed in" cross-section of the upper portion of the head 5.

FIG. 13 is a three-dimensional illustration of the interface between the head 5 and the reservoir 2. FIG. 14 is a "zoomed in" cross-section of FIG. 13. Together, FIGS. 13 and 14 depict the utility of the guide base 19. Not only does the guide base 19 secure the shaft guide 18 in place via the shaft guide arms 32 which extend through the nooks 33 in the guide base 19, but the guide base 19 also seals the interface of the head 5 and the reservoir 2 interface, and thus also seals the channel 21. In FIG. 14, the lower portion of the guide base 19 is positioned between the reservoir tip 35 and the inner ledge 36 of the head 5. Also, FIG. 14, depicts how the deformation of the guide base 19 between the reservoir tip 35 and the inner ledge 36 seals the interface of the reservoir 2 and the head 5. Accordingly, the fluid substance stored in the reservoir 2 may not escape the dispenser 1 while stored therein, or while moving through the channel 21 between the reservoir cavity 20 and the head cavity 22.

Figure 15:
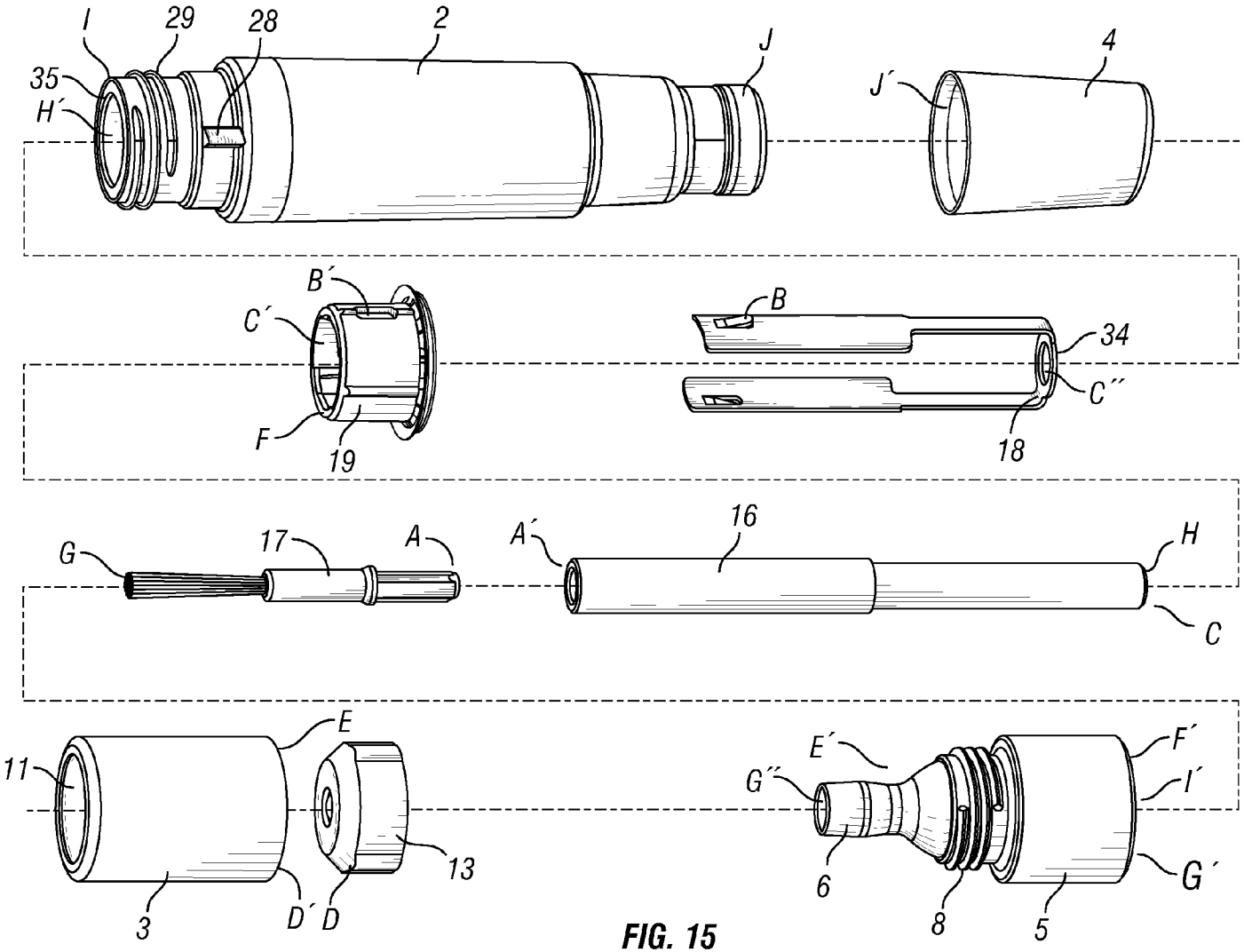
FIG. 15 is a disassembled view of the components of a dispenser 1 which generally depicts the dispenser 1 assembly along the dashed line.

FIG. 15 represents an inventory of components necessary for dispenser 1 assembly. FIG. 15 also represents a disassembled view of the dispenser 1 of the present application, which may generally be assembled along the dashed line beginning with the cap top 11 in the lower left of figure, continuing to the tail cap 4 in the upper right (when viewed horizontally). More specifically, the dispenser 1 may be assembled as follows. First, the hood 13 is positioned inside the cap 3 (D to D'). Though the cap 3 and the hood 13 of the present embodiment are pictured as separate components, in an alternate embodiment the hood 13 and the cap 3 could be fabricated as a single unit. In addition, the threads of the cap 3 could alternatively be fabricated into the hood 13. Next, the applicator assembly 17 is attached to the weighted shaft 16. In the present embodiment, the end of the applicator assembly 17 without the applicator 7 is femininely received by the weighted shaft 16 (A to A'), although in an alternate embodiment, the applicator assembly 17 and the weighted shaft 16 could be fabricated as a single unit. Then, the shaft guide 18 is connected to the guide base 19 via extension of the arms 32 into nooks 33 (B to B'). In this particular embodiment, the guide base 19 and shaft guide 18 are fabricated as separate components, although in alternate embodiments, these components could be fabricated as a single unit. Now, the segment of the weighted shaft 16 with the smaller diameter, followed by the rest of the weighted shaft 16 and then the applicator assembly 17 are inserted into the opening (C') of the guide base 19. The smaller diameter segment of the weighted shaft 16 continues through the aperture 34 in the rear of the shaft guide 18 (C to C' to C"). At this point, the weighted shaft 16 should extend through the aperture 34 at the rear of the shaft guide 18, with the applicator 7 extending from the opening (C') of the guide base 19. Next, the head 5 may be rotatably inserted into the cap 3 (E to E'). Then, the guide base 19 is inserted into the rear of the head 5 (F to F') while the applicator 7 is simultaneously passed into the rear of the head 5 and up into the avenue 9 of the nose 6 (G to G' to G").

At this point the reservoir cavity may be filled with the fluid substance to be stored in the dispenser 1. After said substance has been loaded into the reservoir cavity 20 (with the requisite under-fill mentioned above), all the heretofore combined components (as a separate sub-assembly), are inserted together into the reservoir cavity 20. To do so, the extended portion of the weighted shaft 16 (H to H') is inserted into the reservoir cavity, until the reservoir tip 35 rotatably enters the rear of the head 5 (I to I'). This allows the nut 30 and the screw 29 threads to interact until the locking lugs 28 have locked the head in place via the teeth 31 as described above in connection with FIGS. 11 through 14. Inserting the separate sub-assembly into the reservoir cavity 20 after it has been loaded with contained substance allows for manufacturing ease and for a filling process that is very similar to current cosmetic lacquer dispensers. Finally, the tail cap 4 is placed over the distal end of the reservoir 2 (J to J'). Other assembly methods may be practiced depending on the use of alternative embodiments described herein, and will be readily apparent to those skilled in the art.

We claim:

1. A toggling dispenser comprising:

a head defined by a nose with an avenue that is in fluid communication with one end of a nose cone; said end of said nose cone having a diameter slightly smaller than said avenue;

a reservoir in fluid communication with said nose cone containing a fluid substance;

an integrally situated applicator composing an applicator assembly wherein said applicator is operationally configured to enter and exit said dispenser from the nose via the avenue at the user's election;

a means for controlling said applicator and applicator assembly, wherein said means for controlling said applicator is operationally configured to initiate by movement or shifting of said dispenser;

wherein said applicator assembly is configured for (a) pumping a metered amount of said contained fluid substance to within the avenue whenever the applicator exits the nose and (b) plugging the fluid communication between the avenue and nose cone to create a shut-off at said smaller diameter of said nose cone;

wherein said shut-off separates the metered amount of substance from the remainder of the substance wherein said metered amount of said contained fluid substance collects on said applicator when re-entering the dispenser; and wherein pumping said metered amount of said contained fluid substance and establishment of said shut-off are timed with said exit of said applicator from said dispenser.

2. The toggling dispenser of claim 1 further comprising a removable cap which is operationally configured to prevent the release of said contained fluid substance, and to prevent said exit of said applicator from said dispenser.

3. The toggling dispenser of claim 1 wherein said means for controlling said applicator is defined by a shaft guide and a weighted shaft.

4. The toggling dispenser of claim 1 wherein pumping said metered amount of said contained fluid substance is accomplished by a weighted shaft pushing the applicator assembly through said contained substance and stopping said movement via the establishment of the shut-off so that the metered amount of substance is delivered to the avenue on one side of the shut-off while the remaining substance is separately retained within the dispenser on the other side of the shut-off.

5. The toggling dispenser of claim 4 wherein the nose cone is funnel shaped from the reservoir to the avenue.

6. The toggling dispenser of claim 1 further comprising:

wherein said head and said reservoir are assembled as a single unit; and, a channel between said head and said reservoir.

7. The toggling dispenser of claim 6 further comprising a removable cap which is operationally configured to accept said nose of said dispenser, to prevent escape of said contained fluid substance, and to prevent said exit of said applicator from said dispenser.

8. The toggling dispenser of claim 1 further comprising a slanted tail cap to minimize the drying out of said applicator.

9. The toggling dispenser of claim 6 operationally configured with a slanted tail cap to minimize the drying out phenomena of said contained fluid substance.

10. The toggling dispenser of claim 1 wherein said applicator is defined by a brush.

11. The toggling dispenser of claim 1 wherein said contained fluid substance is nail polish.

12. The toggling dispenser of claim 6 further comprising a means for sealing said channel between said head and said reservoir.

13. The toggling dispenser of claim 12 wherein said means for sealing said channel is a guide base.

14. A cosmetic dispenser comprising:

a head defined by a nose with an avenue that is in fluid communication with one end of a nose cone; said end of said nose cone having a diameter slightly smaller than said avenue;

a reservoir containing a fluid substance, wherein said reservoir is in fluid communication with said nose cone;

an integrally situated applicator assembly with an applicator which is operationally configured to enter and exit said dispenser at the user's election;

wherein said head and said reservoir are assembled as a single unit;

weighted shaft connected to said applicator assembly, wherein said weighted shaft responds to gravity to move the applicator by movement or shifting of said dispenser;

wherein said applicator assembly is configured for (a) pumping a metered amount of said contained fluid substance to within the avenue whenever the applicator exits the nose and (b) plugging the fluid communication between the avenue and nose cone to create a shut-off at said smaller diameter of said nose cone;

wherein said shut-off separate the metered amount of substance from the remainder of the substance if the applicator has exited the dispenser;

wherein said avenue is operationally configured to facilitate collection of said metered amount of said contained fluid substance on said applicator; and wherein for pumping said metered amount of said contained fluid substance and establishment of said shut-off are timed with said exit of said applicator from said dispenser.

15. The dispenser of claim 14 wherein said shut-off is achieved by interaction of said nose cone and applicator assembly under the weighted shaft.

16. The dispenser of claim 14 wherein the nose cone is funnel shaped.

17. The dispenser of claim 14 wherein said contained fluid substance is a cosmetic lacquer.

18. The dispenser of claim 14 wherein said dispenser is operationally configured to prevent the release of said contained fluid substance when said dispenser is tipped over.

19. The dispenser of claim 1 further comprising a slanted tail cap.

20. A hand-held cosmetic lacquer dispenser comprising:

a head defined by a nose with an avenue that is in fluid communication with one end of a nose cone; said end of said nose cone having a diameter slightly smaller than said avenue;

a body, containing lacquer; and, an applicator assembly with an applicator, wherein said applicator is togglable between an internal or external location relative to said head, wherein said applicator assembly is configured to (a) push the applicator to said external location, (b) push a portion of said contained lacquer onto a wall of the avenue and (c) plug said avenue at said smaller diameter of said nose cone so that said portion of lacquer is isolated from the remainder of said lacquer, wherein the applicator is operationally configured to accumulate said portion of said contained lacquer from said wall when toggled to said internal location, and wherein the applicator is operationally configured to deliver said accumulated portion of said lacquer to a target after toggling to the external location.

21. The dispenser of claim 20, wherein said toggling applicator is operationally configured to extend from said body whenever said body is shifted forward, and retract within said body whenever said body is shifted backwards.

22. The dispenser of claim 20, wherein said toggling is accomplished via shifting said body forward to extend said applicator from said body, and shifting said body backwards to retract said applicator.

23. The dispenser of claim 22, wherein said toggling applicator is a brush.

24. A method of applying cosmetic lacquer to a target comprising:

obtaining a hand-held cosmetic dispenser featuring a body containing lacquer, and an applicator assembly with an applicator which is togglable between internal and external locations relative to said body through an avenue at an end of a nose cone that is coupled to said body so that the lacquer is in fluid communication with said avenue; said end of said nose cone having a diameter slightly smaller than said avenue;

pumping a portion of said lacquer to the avenue by moving the applicator assembly through the lacquer while toggling the applicator to the external location;

separating said portion of lacquer from the remainder of the lacquer by plugging the avenue with the applicator assembly at said smaller diameter of said nose cone;

toggling said applicator to said internal location whereby said portion of said contained lacquer is accumulated on said applicator from said avenue;

toggling said applicator and said accumulated portion of said contained lacquer to said external location, which toggling results in another portion of said contained lacquer being separated within said avenue from the remainder of lacquer; and, applying said accumulated lacquer to a target via contact with said applicator.

25. The method of claim 24, wherein said toggling is accomplished via shifting said body forward to extend said applicator to said external locations, and shifting said applicator backwards to retract said applicator to said internal location.

* * * * *